United States Patent [19]

Ikeda et al.

[11] Patent Number: 4,880,361

[45] Date of Patent: Nov. 14, 1989

[54] MULTI-PISTON SWASH PLATE TYPE COMPRESSOR WITH ARRANGEMENT FOR INTERNAL SEALING AND FOR UNIFORM DISTRIBUTION OF REFRIGERANT TO CYLINDER BORES

[75] Inventors: Hayato Ikeda; Kazuhiro Ohta; Hisato Kawamura, all of Kariya, Japan

[73] Assignee: Kabushiki Kaisha Toyoda Jidoshokki Seisakusho, Aichi, Japan

[21] Appl. No.: 193,367

[22] Filed: May 12, 1988

[30] Foreign Application Priority Data

May 13, 1987 [JP] Japan ..... 62-114451

[51] Int. Cl.[4] ..... F04B 1/16; F04B 1/00

[52] U.S. Cl. ..... 417/269; 184/6.17; 184/6.23

[58] Field of Search ..... 417/269, 270; 184/6.17, 184/6.23

[56] References Cited

U.S. PATENT DOCUMENTS

| | | | |
|---|---|---|---|
| 3,955,899 | 5/1976 | Nakayama | 417/269 |
| 4,717,313 | 1/1988 | Ohno | 417/269 |
| 4,746,275 | 5/1988 | Iwamori | 184/6.17 |

FOREIGN PATENT DOCUMENTS

| | | | |
|---|---|---|---|
| 96185 | 8/1981 | Japan | 417/269 |
| 148786 | 9/1987 | Japan . | |

*Primary Examiner*—William L. Freeh

*Attorney, Agent, or Firm*—Burgess, Ryan & Wayne

[57] ABSTRACT

A multi-piston swash plate type compressor for an air-conditioning system used in a vehicle such as an automobile, the compressor having combined cylinder blocks closed, at both axial end faces thereof, by front and rear housings each having a radially inner suction chamber and an outer discharge chamber isolated from the suction chamber, valve plates interposed between the axial end faces of the combined cylinder blocks and the front and rear housings, respectively, a plurality of elongated screw bolts axially and hermetically assembling the combined cylinder blocks, the front and rear housings and the valve plates, and an internal sealing and guiding unit arrnaged in the suction chambers of the front and rear housings for rigidly holding the valve plates against a high pressure of a refrigerant after compression, to reinforce the hermetic seal between the axial end faces of the combined cylinder blocks and the valve plates, and for guiding refrigerant flows within the suction chamber to provide a uniform distribution of the refrigerant to cylinder bores formed in the combined cylinder blocks.

2 Claims, 5 Drawing Sheets

MULTI-PISTON SWASH PLATE TYPE COMPRESSOR WITH ARRANGEMENT FOR INTERNAL SEALING AND FOR UNIFORM DISTRIBUTION OF REFRIGERANT TO CYLINDER BORES

BACKGROUND OF THE INVENTION (1) Field of the Invention

The present invention relates to a compressor for an air-conditioning system used in a vehicle such as an automobile, more particularly, to a multi-piston swash plate type compressor fitted with an internal sealing device and able to ensure a uniform distribution of refrigerant to cylinder bores.

(2) Description of the Related Art

A multi-piston swash plate type compressor for use in a vehicle air-conditioning system is well known, as disclosed in, for example, U.S. Pat. Nos. 4,070,136, 4,403,921, and 4,717,313 to the same assignee as of the present application. In general, such a multi-piston swash plate type compressor comprises: front and rear cylinder blocks axially combined together to form a swash plate chamber therebetween, the combined cylinder blocks having a same number of cylinder bores radially formed therein and arranged with respect to the central axis thereof, the cylinder bores of the front cylinder block being aligned and registrated with the cylinder bores of the rear cylinder block, respectively, with the swash plate chamber intervening therebetween; double-headed pistons slidably received in the pairs of aligned cylinder bores, respectively; front and rear housings connected to the front and rear end faces of the combined cylinder blocks through the intermediary of front and rear valve plates, respectively, the front and rear housings each forming a suction chamber and a discharge chamber together with the corresponding one of the front and rear valve plates; a rotatable drive shaft axially extended through the front housing and the combined cylinder blocks; and a swash plate securely mounted on the drive shaft within the swash plate chamber, and engaging with the double-headed pistons to cause these pistons to be reciprocated in the pairs of aligned cylinder bores, respectively, by rotation of the swash plate. The front and rear cylinder blocks, the front and rear valve plates and the front and rear housings are axially and tightly assembled as an integrated unit by a plurality of long screw bolts.

Referring to the front and rear valve plates in particular, which may have substantially the same construction, each plate comprises: a disc-like member provided with sets of a suction port and a discharge port, each set of which is able to communicate with the corresponding one of the cylinder bores of the front or rear cylinder block; a first valve sheet member attached to the inner side surface of the disc-like member and opposed to the corresponding end face of the combined cylinder blocks, and having suction reed valve elements formed therein, each of which valve elements is arranged so as to open and close the corresponding suction port of the disc-like member; and a second valve sheet member attached to the outer side surface of the disc-like member and having discharge reed valve elements formed therein, each of which valve elements is arranged so as to open and close the corresponding discharge port of the disc-like member. Each of the front and rear valve plates is also provided with suction openings which are aligned with passageways formed in the front or rear cylinder block, respectively, whereby the suction chambers formed in the front and rear cylinder blocks are communicated with the swash plate chamber into which a refrigerant is introduced from an evaporator of an air-conditioning system through a suitable inlet port formed in the combined cylinder blocks.

In the multi-piston swash plate type compressor as mentioned above, the drive shaft is driven by the engine of a vehicle such as an automobile so that the swash plate is rotated within the swash plate chamber. The rotational movement of the swash plate causes the double-headed pistons to be reciprocated in the pairs of aligned cylinder bores so that the pistons alternately execute a suction stroke and a compression stroke. When each of the pistons executes the suction stroke, the suction reed valve element is opened and the discharge reed valve element is closed, so that the refrigerant is sucked into the cylinder bore from the suction chamber, which is communicated with the swash plate chamber, through the suction port of the front or rear valve plate, and when the piston executes the compression stroke, the suction reed valve element is closed and the discharge reed valve element is opened, so that the sucked refrigerant is compressed and discharged into the discharge chamber through the discharge port of the front or rear valve plate.

As is well known, the refrigerant in the air-conditioning system includes a lubricating oil dispersed therein as a mist. This is to ensure that movable parts of the compressor, such as the double-headed pistons, the swash plate, thrust bearings of the swash plate, radial bearings of the drive shaft, etc., are lubricated with the lubricating oil included in the refrigerant during the passage of the refrigerant through the compressor.

The conventional compressor can be provided with either of two different arrangements of the suction and discharge chambers, i.e., the suction chamber is arranged inside the discharge chamber in the front and rear housings, or the suction chamber is arranged outside the discharge chamber in the front and rear housings. The former arrangement possesses an advantage of simplifying the internal construction of the front housing because a sealing portion of the drive shaft disposed adjacent to the suction chamber need not be isolated therefrom due to a low pressure created in the suction chamber. In the multi-piston swash plate type compressor employing the inside suction chamber arrangement, as disclosed in, for example, Japanese Examined Patent Publication No. 56-27710 and U.S. Pat. No. 4,717,313, the suction and discharge chamber are formed in inner and outer annular chambers which are separated from each other by an annular partition wall integrally projected from the inner side wall surfaces of the front and rear housings.

As stated above, the front and rear cylinder blocks, the front and rear valve plates, and the front and rear housings are axially and tightly assembled as an integrated unit by a plurality of long screw bolts. In this case, since the screw bolts are extended around the periphery of the integrated unit, the central portion of the front and rear valve plates, i.e., the portion facing the suction chamber of the front and rear housings, is less affected by a clamping force of the screw bolts than the peripheral portion of the valve plates. For this reason, the central portion of the front and rear valve plates may be forcibly deformed and separated from the corresponding end face of the combined cylinder blocks, because the front and rear valve plates are subjected to the high pressure of the compressed refrigerant, and as is obvious, when such deformation occurs, the sealing between the front and rear valve plates and the end faces of the combined cylinder blocks is usually broken. The annular partition wall separating the suction and discharge chambers also serves to suppress deformation of the front and rear valve plates. In particular, the annular partition wall is projected from the inner side wall surface of the front and rear housings in such a manner that the projected annular end face thereof abuts against the outer side surface of the front and rear valve plates when the unit is assembled, whereby deformation is suppressed by the annular partition wall abutting against the outer side surface of the front and rear valve plates.

Nevertheless, in a multi-piston swash plate type compressor, especially a ten-cylinder (five front and five rear) swash plate type compressor, it is very difficult to completely suppress deformation of the front and rear valve plates only by the annular partition wall, because a slight gap is formed through which the high pressure refrigerant compressed within the cylinder bores is easily and directly diverted into the passageways formed in the cylinder blocks, as pointed out in U.S. Pat. No. 4,717,313, which leads to a lowering of the compression efficiency of the compressor, and accordingly, the cooling efficiency of the air-conditioning system.

U.S. Pat. No. 4,717,313 is directed to a complete suppression of the deformation of the front and rear valve plates by using support ribs which are projected from the inner side wall surface of the front and rear housings so that the projected end faces thereof abut against the outer side surface of the front and rear valve plates, thereby preventing the formation of the slight gap mentioned above.

Nevertheless, U.S. Pat. No. 4,717,313 fails to eliminate another drawback inherently involved in the multi-piston swash plate type compressor. Namely, in particular, the refrigerant introduced into the swash plate chamber through the inlet port is influenced by the rotational movement of the swash plate and thus tends to circulate in the rotational direction of the swash plate. This circulating flow of refrigerant, which starts at the inlet port, is gradually reduced because a portion of the circulating refrigerant flow successively enters the passageways of the cylinder blocks and the respective flow rates of refrigerant passing through the passageways of the cylinder blocks then become different from each other. For this reason, the refrigerant entering into the suction chamber through the passageways has a very unbalanced density and cannot be uniformly delivered and distributed to the cylinder bores. As a result, a lack of lubricating oil occurs in a cylinder bore to which only a small amount of the refrigerant including the lubricating oil is delivered, whereby a seizure of the pistons therein may occur. Especially, the cylinder bores disposed adjacent to the passageways through which the refrigerant passes at a small flow rate are liable to lack lubrication. In the multi-piston swash plate type compressor as disclosed in U.S. Pat. No. 4,717,313, the lack of lubrication may be worsened due to the existence of the support ribs provided within the suction chamber.

SUMMARY OF THE INVENTION

An object of the present invention is, therefore, to obviate the drawbacks encountered by the conventional multi-piston swash plate type compressor.

In accordance with the present invention, there is provided a multi-piston swash plate type compressor for an air-conditioning system used in a vehicle such as an automobile, which comprises: a pair of axially combined front and rear cylinder blocks forming therein a plurality of cylinder bores and a swash plate chamber; a pair of front and rear housings arranged at the axial end faces of the combined cylinder blocks, each housing having therein an inner suction chamber for a refrigerant prior to compression and an outer discharge chamber for a refrigerant after compression; an annular partition wall arranged in each of the front and rear housings for isolating the inner suction chamber from the outer discharge chamber; valve plates interposed between the front and rear housings and the axial end faces of the combined cylinder blocks, respectively; a plurality of tightening screw bolts for axially and hermetically assembling the front and rear housing, the valve plates and the combined cylinder blocks as an integrated unit; a drive shaft extending axially through the swash plate chamber of the combined cylinder blocks; a swash plate mounted on the drive shaft within the swash plate chamber; a plurality of pistons engaged with the swash plate and reciprocated in the cylinder bores; a plurality of inlet passageways extending through the combined cylinder blocks and the valve plates for communication between the swash plate chamber and the suction chambers of the front and rear housings; and internal sealing and guiding means arranged in each of the front and rear housings for providing a hermetic seal between the axial end faces of the combined cylinder blocks and the valve plates, respectively, and for providing a substantially uniform distribution of refrigerant from the suction chamber to the cylinder bores, the internal sealing and guiding means including a plurality of rib members individually provided in each of the front and rear housings for rigidly holding the valve plates against a high pressure of the refrigerant after compression within the cylinder bores of the combined cylinder blocks, and arranged to guide refrigerant flows entering the suction chamber though the inlet passageways to carry out a uniform distribution of the refrigerant, thereby reinforcing a hermetic seal between the axial end faces of the combined cylinder blocks and the valve plates, respectively, while lubricating all of the cylinder bores with a lubricating oil included in the uniformly distributed refrigerant.

In the present invention, preferably the rib members are integrally projected from the inner bottom wall of the front and rear housings so that the projected end faces thereof abut against the outer side surface of the valve plates when assembled, the projected rib members being circumferentially spaced from one another.

In one embodiment according to the present invention, all of the rib members are integrally extended from the inner side wall portion of the annular partition wall in such a manner that they guide the refrigerant flows toward the corresponding cylinder bores, respectively.

In a preferable embodiment according to the present invention, two of the rib members are integrally extended from the inner side wall portion of the annular partition wall so that the two rib members guide one of the refrigerant flows, having the largest flow rate, and shares it among the corresponding cylinder bores, respectively. One of the remaining rib members is separated from the inner side wall portion of the annular partition wall in such a manner that it guides two of the remaining refrigerant flows, having the first and second smallest flow rates, and leads these two flows together to the corresponding single cylinder bore. The remaining rib members are integrally extended from the inner side wall portion of the annular partition wall so that they guide the remaining refrigerant flows toward the corresponding cylinder bores, respectively.

BRIEF DESCRIPTION OF THE DRAWINGS

The present invention will be made more apparent from the ensuing description of the embodiment thereof, with reference to the accompanying drawings, wherein.

DESCRIPTION OF THE PREFERRED EMBODIMENTS

Figure 1:
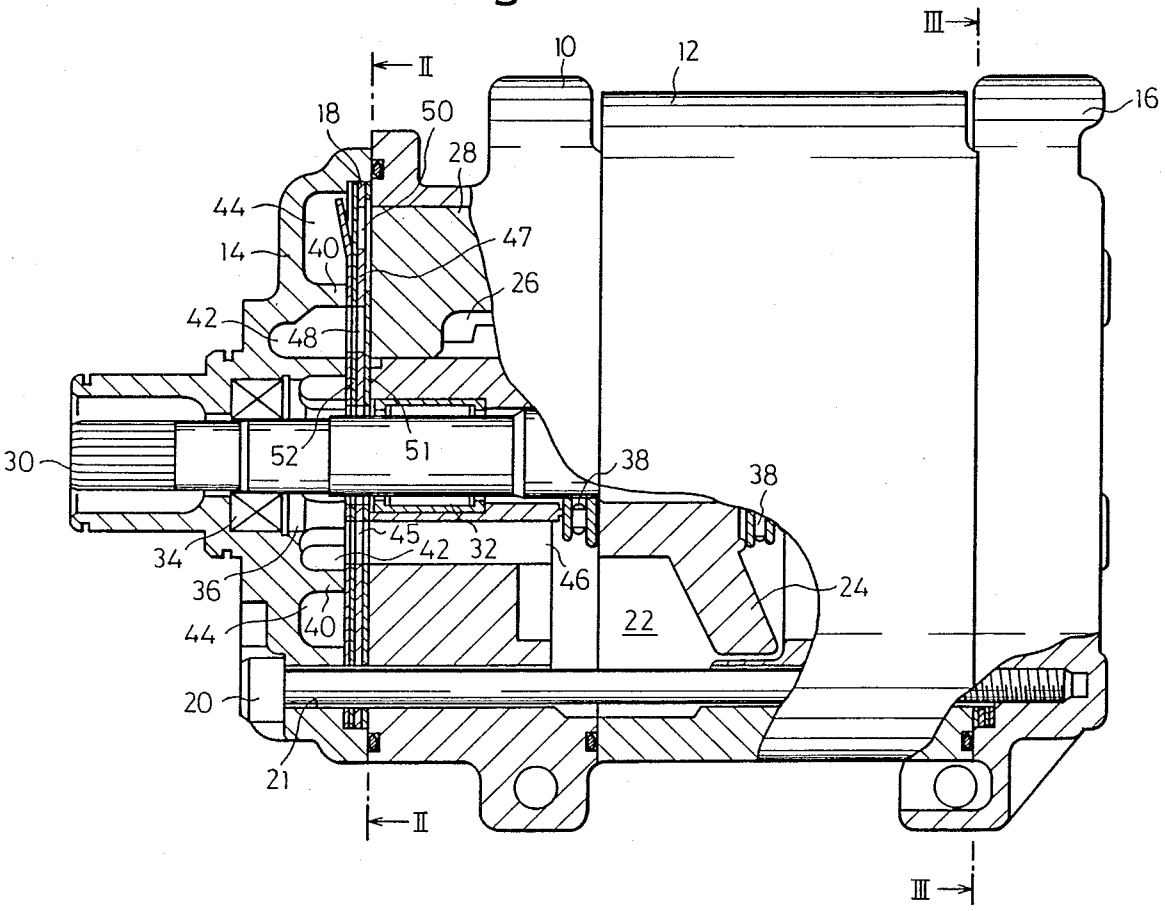
FIG. 1 is a front elevational view, partly cross-sectional, of a multi-piston swash plate type compressor according to the present invention.
Figure 2:
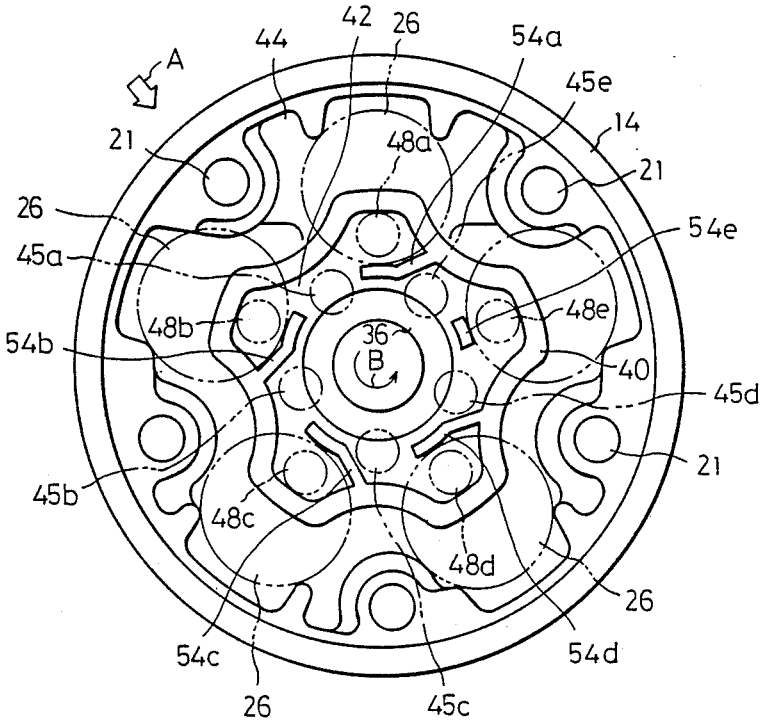
FIG. 2 is a side view of a front housing of the compressor, taken along the line II—II of FIG. 1.
Figure 3:
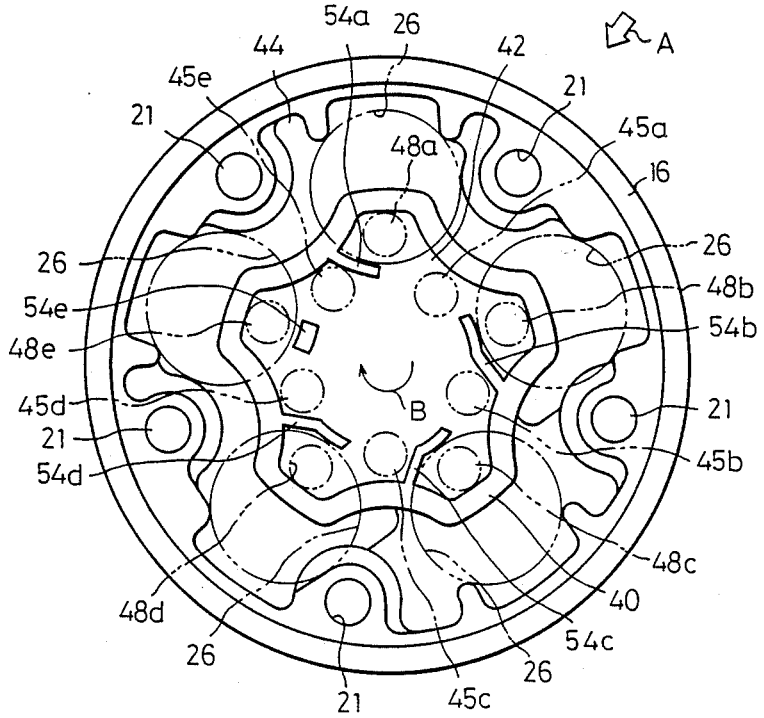
FIG. 3 is a side view of a rear housing of the compressor, taken along the line III—III of FIG. 1.

With reference to FIGS. 1 to 3, a multi-piston swash plate type compressor according to the present invention is constructed as a ten-cylinder compressor. The compressor comprises front and rear cylinder blocks 10 and 12 which are axially aligned and hermetically combined with each other, front and rear housings 14 and 16 disposed on the axial end faces of the combined cylinder blocks 10 and 12, and front and rear valve plates 18 (in FIG. 1, only the front valve 18 is shown) disposed between the front and rear housings 14 and 16 and the axial end faces of the combined cylinder blocks 10 and 12. All of these parts are assembled as an integrated unit by five elongated screws 20 (in FIG. 1, only one is shown) which extend from the front housing 14 into the rear housing 16 through the combined cylinder blocks 10 and 12 and the front and rear valve plates therebetween. As best shown in FIGS. 2 and 3, five bores 21 for inserting the screw bolts 30 are radially and circumferentially formed in the integrated unit.

The combined cylinder blocks 10 and 12 form a swash plate chamber 22 in which a swash plate member 24 is disposed. As shown in FIGS. 2 and 3, each of the cylinder blocks 10 and 14 has five cylinder bores 26 formed radially and circumferentially therein and spaced from each other at regular intervals. The five cylinder bores 26 of the cylinder block 10 are aligned and registrated with those of the cylinder block 12, respectively, and each pair of the aligned cylinder bores of the blocks 14 and 16 slidably receives a double-headed piston 28 operatively engaged with the swash plate 24 in a manner such that the piston 28 is reciprocated by the rotation of the swash plate 24. The swash plate chamber 22 is in communication with an evaporator of an air-conditioning system (not shown) incorporated into a vehicle such as an automobile, so that the swash plate chamber 22 is fed with a refrigerant including a lubricating oil therein.

As shown in FIG. 1, the combined cylinder blocks 10 and 12 are provided with a central axial bore which receives a drive shaft 30 extending through the swash plate chamber 22. The drive shaft 30 is rotatably supported within the central axial bore by a pair of radial bearings 32 (in FIG. 1, only one is shown) which are provided in the cylinder blocks 10 and 12, respectively. One end portion of the drive shaft 30 is extended through the front valve plate 18 and is then protruded behind the outer end face of the front housing 10 so as to be operatively connected to a prime motor of the vehicle for rotation of the drive shaft 30. The protruded end portion of the drive shaft 30 is sealed by a well-known rotary seal device 34 which is contained within a cylindrical sealing chamber 36 to prevent the refrigerant from leaking outside of the compressor.

The swash plate 24 is fixedly mounted on the drive shaft 30 within the swash plate chamber 22 so that the swash plate 24 is rotationally driven by the prime motor of the vehicle. Since the swash plate 24 is subjected to a thrust force during a rotational operation thereof, a pair of thrust bearings 38 is provided around the drive shaft 30 at opposite sides of a central portion of the swash plate 24.

The front housing 14, which may be constructed substantially in the same manner as the rear housing 16, is provided with an annular partition wall 40 arranged therein to define an inner circular suction chamber 42 and an outer annular discharge chamber 44 between the outer surface of the front valve plate 18 and the inner bottom surface of the front housing 14. In this embodiment, the annular partition wall 40 is integrally projected from the inner bottom surface of the front housing 14 so that the projected end face thereof abuts against the outer side surface of the front valve plate 18. In order to communicate the swash plate chamber 22 with the suction chamber 42, the front valve plate 18 has five inlet openings 45 formed radially and circumferentially therein at regular intervals, and the front cylinder block 10 has five passageways 46 extended therethrough and aligned with the inlet openings 45, respectively, whereby the suction chamber is fed with the refrigerant including the lubricating oil from the swash plate chamber 22 through the passageways 46 and the inlet openings 45. This is the same for the rear cylinder block 12, the rear housing 16, and the rear valve plate. Note that, in FIG. 2, the five inlet openings are designated by reference symbols 45*a* to 45*e*, to distinguish them from one another.

The front valve plate 18, which may be substantially identical to the rear valve plate, includes a disc-like member 47 having five sets of a suction port 48 and a discharge port 50 formed radially and circumferentially therein and spaced from each other at regular intervals, as shown in FIG. 2. Both the suction and discharge ports 48 and 50 in each set, which are radially aligned with each other, are encompassed within an end opening area of the corresponding one of the cylinder bores 26, as best shown in FIG. 1. Note that the discharge ports 50 are not illustrated in FIG. 2 and that, in FIG. 2, the suction ports are designated by reference symbols 48*a* to 48*c* to distinguish them from one another. The valve plate 18 also includes a first reed valve sheet 51 disposed between the end face of the cylinder block 10 and the inner side surface of the disc-like member 47. The first reed valve sheet 51 has five suction reed valve elements formed radially and circumferentially therein.

The five reed valve elements are arranged so that they are registrated with the five suction ports 48, respectively, whereby each suction reed valve element can be moved so as to open and close the suction port 48. The front valve plate 18 further includes a second reed valve sheet 52 applied to the outer side surface of the disc-like member 47. The second reed valve sheet 52 has five discharge reed valve elements formed radially and circumferentially therein. The five discharge reed valve elements are also arranged so that they are registrated with the discharge ports 50, respectively, whereby each discharge reed valve element can be moved so as to open and close the discharge port 50. This is the same for the rear valve plate.

As shown in FIGS. 2 and 3, the annular partition walls 40 of the front and rear housing 14 and 16 have a generally pentagonal shape so that each wall 40 encompasses the five inlet openings 45 and the five suction ports 48 of the front and rear valve plates, respectively. The adoption of the generally pentagonal shape of the annular partition wall 40 is due to the necessity for an equiangular arrangement of the five bores 21 for the screw bolts 20 and the suction ports 48 for communicating the suction chamber 42 with the cylinder bores 26.

In operation, when each piston 28 executes the suction stroke, the suction reed valve element is opened and the discharge reed valve element is closed, so that the refrigerant is delivered from the suction chamber 42 to the cylinder bore 26 through the suction port 48. Then, when the piston 28 executes the compression stroke, the suction reed valve element is closed and the discharge reed valve element is opened, so that the delivered refrigerant is compressed and discharged from the cylinder bore 26 into the discharge chamber 44 through the discharge reed valve element.

The construction of the compressor and the operational principle thereof mentioned above are essentially identical to those of the conventional compressor as disclosed in the above-cited references, but the compressor according to the present invention is further characterized in that the front and rear housings 14 and 16 include internal sealing and guiding means incorporated therein for completely suppressing deformation of the front and rear valve plates, and thus prevent a breakage of the internal sealing resulting therefrom, and for insuring a uniform distribution of the refrigerant to the cylinder bores 26 to prevent a lack of lubricating oil therein.

Figure 4:
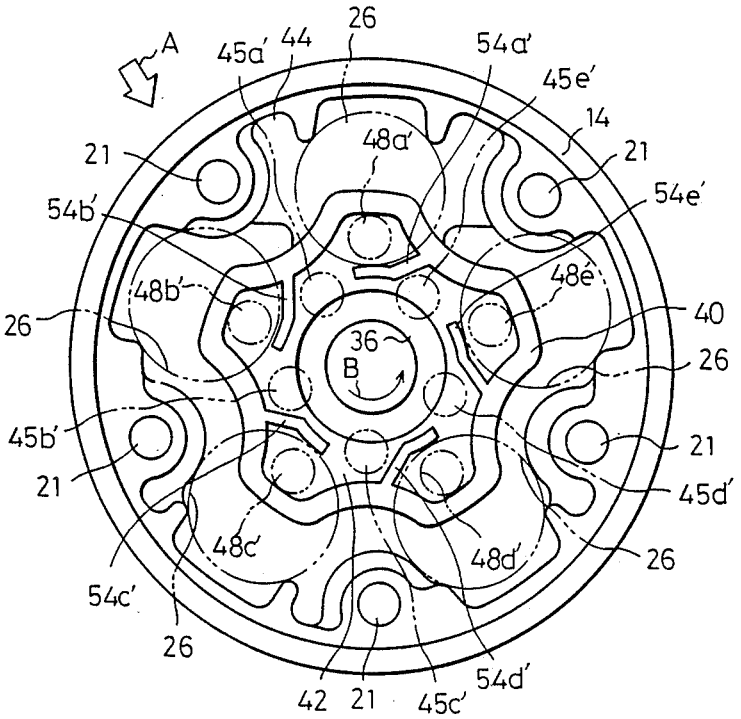
FIGS. 4 and 5 are side views similar to FIGS. 2 and 3, respectively, showing a modification of the embodiment of FIGS. 1 to 3.

The internal sealing and guiding means includes a plurality of rib members 54 (five in this embodiment, although only one is shown in FIG. 1) which are integrally projected from the inner bottom surface of the front and rear housings 14 and 16, and which are disposed inside the annular partition wall 40, as shown in FIGS. 2 and 4, wherein the five rib members are designated by reference symbols **54*a* to 54*e* to distinguish them from one another. The projected end faces of the rib members 54*a* to 54*e* abut against the inner side surface of the front and rear valve plates when assembled, so that deformation of the front and rear valve plates, which may be caused by the high pressure refrigerant compressed within the cylinder bores 26, can be effectively suppressed with the aid of the supporting abutment of the rib members 54*a* to 54*e***.

If the refrigerant returning from the evaporator of the air-conditioning system to the compressor is introduced into the swash plate chamber 26, as shown by an open arrow A in FIGS. 2 and 3 (that is, the inlet port of the combined cylinder blocks 10 and 12 is at the location designated by the open arrow A), it is influenced by the rotational movement of the swash plate 24 and thus circulates in the rotational direction of the swash plate 24, as shown by an arrow B in FIGS. 2 and 3. This circulating flow of refrigerant, which starts at the inlet port, is gradually reduced because a portion of the circulating refrigerant flow successively enters the passageways 46 of the combined cylinder blocks 10 and 12 in the circulating direction of the refrigerant so that the respective flow rates of refrigerant passing through the passageways 54 of the combined cylinder blocks 10 and 12 become different from one another. In particular, a flow rate of the refrigerant which enters the suction chamber 42 through the inlet opening **45*a* is largest because it is nearest to the inlet port of the combined cylinder blocks 10 and 12, and a flow rate of the refrigerant at the inlet opening 45*b* is smaller than that at the inlet opening 45*a* because the inlet opening 45*b* is downstream of the inlet opening 45*a* in the circulating direction of refrigerant. This is the same for the relationships among the inlet openings 45*b* to 45*e*. In short, a flow rate of the refrigerant at the inlet opening 45*e* is smallest, and for this reason, the refrigerant entering the suction chamber 42 through the inlet openings 45*a* to 45*e* has a very unbalanced density and thus cannot be uniformly delivered and distributed to the cylinder bores 26**.

To avoid a nonuniform distribution of the refrigerant to the cylinder bores 26, the rib members **54*a* and 54*b* are arranged to positively guide the refrigerant flowing out of the inlet opening 45*a* toward the suction ports 48*a* and 48*b*, respectively. That is, the suction ports 48*a* and 48*b* share the largest flow rate of the refrigerant at the inlet opening 45*a*. Also, the rib members 54*c* and 54*d* are arranged to positively guide the relatively small refrigerant flows from the inlet openings 45*b* and 45*c* toward the suction ports 48*c* and 48*d*, respectively. Furthermore, the rib member 54*e* is arranged to positively guide the very small refrigerant flows from the inlet openings 45*d* and 45*e* toward the suction port 48*e*. With the arrangement mentioned above, although the refrigerant within the suction chamber 42 has a very unbalanced density, it is possible to uniformly deliver and distribute it to the five cylinder bores 26 through the suction ports 48*a* to 48*e*, respectively. Note that, although the rib members 54*a* to 54*d* are integrally extended from inner side wall portions of the annular partition wall 40**, they may be separated therefrom, if desired.

Figure 5:
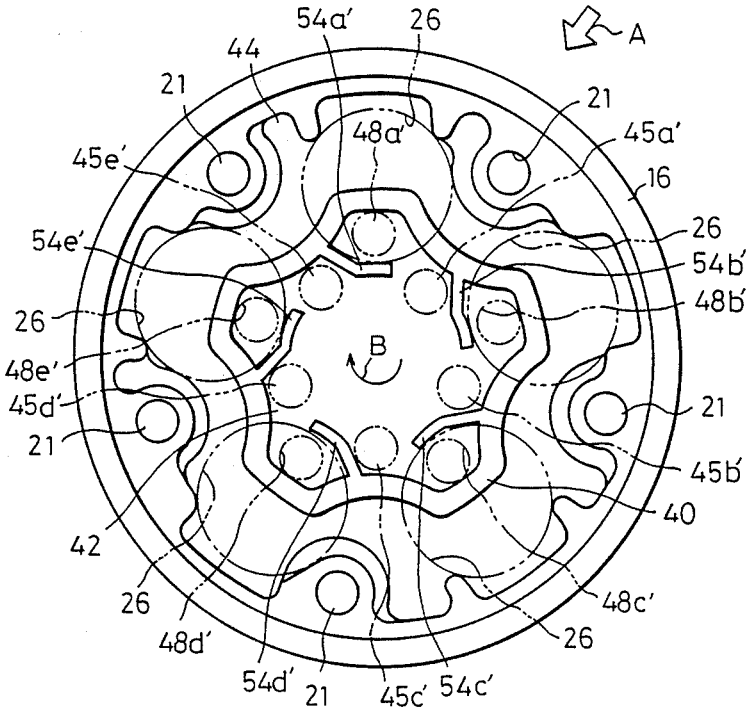

FIGS. 4 and 5 corresponding to FIGS. 2 and 5 show a modification of the first embodiment mentioned above, this modified embodiment is identical to the first embodiment except that the rib members **54*a*′ to 54*e*′ are arranged to positively guide the refrigerant flows from the inlet openings 45*a*′ and 45*e*′ toward the suction ports 48*a*′ and 48*e*′, respectively. In this arrangement, the distribution of refrigerant to the cylinder bores 26 is still unbalanced, but each of the inlet openings 45*a*′ to 45*e*′ firmly supports the corresponding one of the suction ports 48*a*′ and 48*e*′, respectively. Note, the arrangement concerned is possible only on the condition that the cylinder bore supported by the inlet opening 45*e*′** is sufficiently lubricated with the smallest flow rate of refrigerant thereat.

Finally, it will be understood by those skilled in the art that the foregoing description is of preferred embodiments of the disclosed devices, and that various changes and modifications may be made to the present invention without departing from the spirit and scope thereof.

We claim:

1. A multi-piston swash plate type compressor for an air-conditioning system used in a vehicle such as an automobile, which comprises:

a pair of axially combined front and rear cylinder blocks forming therein a plurality of cylinder bores and a swash plate chamber;

a pair of front and rear housings arranged at the axial end faces of said combined cylinder blocks, each housing having therein an inner suction chamber for a refrigerant prior to compression and an outer discharge chamber for a refrigerant after compression;

an annular partition wall arranged in each of said front and rear housings for isolating said inner suction chamber from said outer discharge chamber;

valve plates interposed between said front and rear housings and the axial end faces of said combined cylinder blocks, respectively;

a plurality of tightening screw bolts for axially and hermetically assembling said front and rear housing, said valve plates and said combined cylinder blocks as an integrated unit;

a drive shaft extending axially through said swash plate chamber of said combined cylinder blocks;

a swash plate mounted on said drive shaft within said swash plate chamber;

a plurality of pistons engaged with said swash plate so as to be reciprocated in said cylinder bores;

a plurality of inlet passageways extending through said combined cylinder blocks and said valve plates for communication between said swash plate chamber and the suction chambers of said front and rear housings; and internal sealing and guiding means arranged in each of said front and rear housings for providing a hermetic seal between the axial end faces of said combined cylinder blocks and said valve plates, respectively, and for providing a substantially uniform distribution of refrigerant from said suction chamber to said cylinder bores, said internal sealing and guiding means including a plurality of rib members which are individually provided in each of said front and rear housings for rigidly holding said valve plates against a high pressure of said refrigerant after compression within the cylinder bores of said combined cylinder blocks, wherein all of said rib members are integrally extended from the inner side wall portion of said annular partition wall so that they guide the refrigerant flows toward the corresponding cylinder bores, respectively, and wherein said rib members are arranged to guide refrigerant flows entering said suction chamber through said inlet passageways to carry out said uniform distribution of refrigerant, thereby reinforcing a hermetic seal between the axial end faces of said combined cylinder blocks and said valve plates, respectively, while sufficiently lubricating all of said cylinder bores with a lubricating oil included in the uniformly distributed refrigerant.

2. A multi-piston swash plate type compressor for an air-conditioning system used in a vehicle such as an automobile, which comprises:

a pair of axially combined front and rear cylinder blocks forming therein a plurality of cylinder bores and a swash plate chamber;

a pair of front and rear housings arranged at the axial end faces of said combined cylinder blocks, each housing having therein an inner suction chamber for a refrigerant prior to compression and an outer discharge chamber for a refrigerant after compression;

an annular partition wall arranged in each of said front and rear housings for isolating said inner suction chamber from said outer discharge chamber;

valve plates interposed between said front and rear housings and the axial end faces of said combined cylinder blocks, respectively;

a plurality of tightening screw bolts for axially and hermetically assembling said front and rear housing, said valve plates and said combined cylinder blocks as an integrated unit;

a drive shaft extending axially through said swash plate chamber of said combined cylinder blocks as an integral unit a swash plate mounted on said drive shaft within said swash plate chamber;

a plurality of pistons engaged with said swash plate so as to be reciprocated in said cylinder bores;

a plurality of inlet passageways extending through said combined cylinder blocks and said valve plates for communication between said swash plate chamber and the suction chambers of said front and rear housings; and internal sealing and guiding means arranged in each of said front and rear housings for providing a hermetic seal between the axial end faces of said combined cylinder blocks and said valve plates, respectively, and for providing a substantially uniform distribution of refrigerant from said suction chamber to said cylinder bores, said internal sealing and guiding means including a plurality of rib members which are individually provided in each of said front and rear housings for rigidly holding said valve plates against a high pressure of said refrigerant after compression within the cylinder bores of said combined cylinder blocks, wherein two of said rib members are integrally extended from the inner side wall portion of said annular partition wall so that said two rib members guide one of the refrigerant flows having the largest flow rate, and shares said flow among the corresponding cylinder bores, respectively; one of the remaining rib members being separated from the inner side wall portion of said annular partition wall to the guide two of the remaining refrigerant flows, having the first and second smallest flow rates, and lead said flows together to the corresponding single cylinder bore; and wherein the remaining rib members are integrally extended from the inner side wall portion of said annular partition wall so that they guide the remaining refrigerant flows toward the corresponding cylinder bores, respectively, and wherein said rib members are arranged to guide refrigerant flows entering said suction chamber through said inlet passageways to carry out said uniform distribution of refrigerant, thereby reinforcing a hermetic seal between the axial end faces of said combined cylinder blocks and said valve plates, respectively, while sufficiently lubricating all of said cylinder bores with a lubricating oil included in the uniformly distributed refrigerant.

* * * * *